US012415664B2

(12) United States Patent
Yang et al.

(10) Patent No.: US 12,415,664 B2
(45) Date of Patent: Sep. 16, 2025

(54) COVER DEVICE

(71) Applicant: Universal Trim Supply Co., Ltd., New Taipei (TW)

(72) Inventors: Shih-Sheng Yang, Taipei (TW); Chih-Wei Yang, Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 233 days.

(21) Appl. No.: 18/231,799

(22) Filed: Aug. 9, 2023

(65) Prior Publication Data

US 2025/0051067 A1 Feb. 13, 2025

(51) Int. Cl.

| | |
|---|---|
| ***B65D 51/24*** | (2006.01) |
| ***B65D 43/02*** | (2006.01) |
| ***B65D 81/20*** | (2006.01) |

(52) U.S. Cl.

CPC ..... *B65D 51/24* (2013.01); *B65D 43/0202* (2013.01); *B65D 81/2007* (2013.01); *B65D 2543/00092* (2013.01)

(58) Field of Classification Search

CPC .... B65D 51/24; B65D 51/16; B65D 51/1644; B65D 43/0202; B65D 81/2007; B65D 2543/0092

See application file for complete search history.

(56) References Cited

U.S. PATENT DOCUMENTS

| | | | | |
|---|---|---|---|---|
| 3,903,915 | A * | 9/1975 | Rosaz | F16K 15/20 137/232 |
| 5,651,470 | A * | 7/1997 | Wu | F16J 13/24 220/240 |
| 6,712,334 | B2 * | 3/2004 | Motonaka | A45C 7/0081 251/149.6 |
| 7,513,481 | B2 * | 4/2009 | Su | B65D 31/14 206/524.8 |
| 7,607,642 | B2 * | 10/2009 | Kim | B65D 81/2038 251/366 |
| 8,608,380 | B2 * | 12/2013 | Kim | A47G 25/54 206/289 |
| 2003/0015452 | A1 * | 1/2003 | Su | B65D 81/2038 206/524.8 |
| 2014/0263443 | A1 * | 9/2014 | Furusawa | B65D 83/771 222/105 |

* cited by examiner

*Primary Examiner* — Jessica Cahill
(74) *Attorney, Agent, or Firm* — Winston Hsu

(57) ABSTRACT

A cover device is provided and includes a first body, a second body, a resilient component, a seat assembly, a check valve and a filtering component. The second body is removably attached on the first body and resiliently deformable. The resilient component is disposed on the first body. The seat assembly is movable relative to the first body. The seat assembly includes a first seat and a second seat. The first seat is removably engaged with the resilient component and configured to be connected to a vacuum device. The second seat is removably engaged with the first seat. The check valve is disposed on the second seat. The filtering component is disposed between the second seat and the second body.

20 Claims, 9 Drawing Sheets

COVER DEVICE

BACKGROUND OF THE INVENTION

1. Field of the Invention

The present invention relates to a sealing product, and more specifically, to a cover device adapted for a container.

2. Description of the Prior Art

There are various sealing products available in the market. A sealing cover is one of the sealing products. The sealing cover can be placed on a container, such as a cup, and connected to a vacuum device, such as a vacuum pump, so as to create a vacuum environment or a negative pressure environment inside the container for extending a storage time of objects stored inside the container. However, the conventional sealing cover lacks simple and intuitive use. Therefore, an improvement of the sealing cover is urgently needed.

SUMMARY OF THE INVENTION

It is an objective of the present invention to provide a cover device adapted for a container for solving the aforementioned problems.

In order to achieve the aforementioned objective, the present invention discloses a cover device. The cover device includes a first body, a second body, a resilient component, a seat assembly, a check valve and a filtering component. The second body is removably attached on the first body and resiliently deformable. The resilient component is disposed on the first body. The seat assembly is movable relative to the first body. The seat assembly includes a first seat and a second seat. The first seat is removably engaged with the resilient component and configured to be connected to a vacuum device. The second seat is removably engaged with the first seat. The check valve is disposed on the second seat. The filtering component is disposed between the second seat and the second body.

According to an embodiment of the present invention, the first seat includes an engaging component and a connecting component. The engaging component is removably engaged with the resilient component. The connecting component is removably engaged with the engaging component, and the connecting component includes a connecting structure protruding out of the engaging component and configured to be connected to the vacuum device.

According to an embodiment of the present invention, the cover device further includes a recovering component disposed between the first body and the engaging component and for recovering the engaging component.

According to an embodiment of the present invention, the first seat further includes a magnetic component disposed between the engaging component and the connecting component.

According to an embodiment of the present invention, at least one channel is formed on an outer periphery of the engaging component. The resilient component includes at least one inner rib configured to engage with the outer periphery of the engaging component for blocking the at least one channel, and the resilient component is resiliently deformed to disengage the at least one inner rib from the outer periphery of the engaging component so that the at least one inner rib does not block the at least one channel.

According to an embodiment of the present invention, the first body includes a recess structure. The recess structure includes a base, a first wall and a second wall. A through hole is formed on the base. The first wall is adjacent to an outer periphery of the base and configured to removably engage with the resilient component. The second wall is adjacent to an inner periphery of the base and surrounds the through hole, and the second wall is configured to cooperate with the seat assembly.

According to an embodiment of the present invention, the cover device further includes a recovering component sleeved on the second wall and abutting against the base and the engaging component, and the recovering component is configured to recover the engaging component.

According to an embodiment of the present invention, the seat assembly is movable between a first position and a second position. The second wall includes a first stopping portion and a second stopping portion. The first stopping portion abuts against the engaging component when the seat assembly is located at the second position, and the second stopping portion abuts against the second seat when the seat assembly is located at the first position.

According to an embodiment of the present invention, at least one first guiding structure is arranged on the engaging component, and at least one second guiding structure is arranged on the second wall and configured to cooperate with the at least one first guiding structure for preventing a rotating movement of the engaging component.

According to an embodiment of the present invention, the filtering component is driven by the second seat to at least partially protrude out of a space defined by the second wall through the through hole, so as to resiliently deform the second body.

According to an embodiment of the present invention, the cover device further includes a sealing component disposed in a space defined by the engaging component, the connecting component and the second seat.

According to an embodiment of the present invention, the cover device further includes a recovering component disposed between the first body and the first seat and for recovering the first seat.

According to an embodiment of the present invention, at least one channel is formed on an outer periphery of the first seat. The resilient component includes at least one inner rib configured to engage with the outer periphery of the first seat for blocking the at least one channel, and the resilient component is resiliently deformed to disengage the at least one inner rib from the outer periphery of the first seat so that the at least one inner rib does not block the at least one channel.

According to an embodiment of the present invention, the first body includes a recess structure. The recess structure includes a base, a first wall and a second wall. A through hole is formed on the base. The first wall is adjacent to an outer periphery of the base and configured to removably engage with the resilient component. The second wall is adjacent to an inner periphery of the base and surrounds the through hole, and the second wall is configured to cooperate with the seat assembly.

According to an embodiment of the present invention, the cover device further includes a recovering component sleeved on the second wall and abutting against the base and the first seat, and the recovering component is configured to recover the first seat.

According to an embodiment of the present invention, the seat assembly is movable between a first position and a second position. The second wall includes a first stopping portion and a second stopping portion. The first stopping portion abuts against the first seat when the seat assembly is located at the second position, and the second stopping portion abuts against the second seat when the seat assembly is located at the first position.

According to an embodiment of the present invention, at least one first guiding structure is arranged on the first seat, and at least one second guiding structure is arranged on the second wall and configured to cooperate with the at least one first guiding structure for preventing a rotating movement of the first seat.

According to an embodiment of the present invention, the filtering component is driven by the second seat to at least partially protrude out of the first body, so as to resiliently deform the second body.

According to an embodiment of the present invention, the seat assembly is movable between a first position and a second position. The first body includes a first stopping portion and a second stopping portion. The first stopping portion abuts against the first seat when the seat assembly is located at the second position. The second stopping portion abuts against the second seat when the seat assembly is located at the first position. At least one first guiding structure is arranged on the first seat, and at least one second guiding structure is arranged on the first body and configured to cooperate with the at least one first guiding structure for preventing a rotating movement of the first seat.

According to an embodiment of the present invention, the cover device further includes a sealing component disposed in a space defined by the first seat and the second seat.

In summary, the present invention enables the seat assembly to move from a higher position, e.g., the first position, to a lower position, e.g., the second position, when a pressure of an interior of the container gradually decreases. Besides, the present invention further enables the seat assembly to move from the lower position, e.g., the second position, to the higher position, e.g., the first position, when the pressure of the interior of the container gradually increases. Therefore, the pressure of the interior of the container can be estimated by observing a position of the seat assembly easily. Besides, an air passage can be formed for allowing ambient air to flow into the interior of the container when the resilient component is resiliently deformed to drive at least a portion of the resilient component, e.g., the inner rib of the resilient component, and at least a portion of the seat assembly, e.g., the outer periphery of the engaging component of the first seat of the seat assembly, to disengage from each other. Therefore, the present invention has intuitive use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
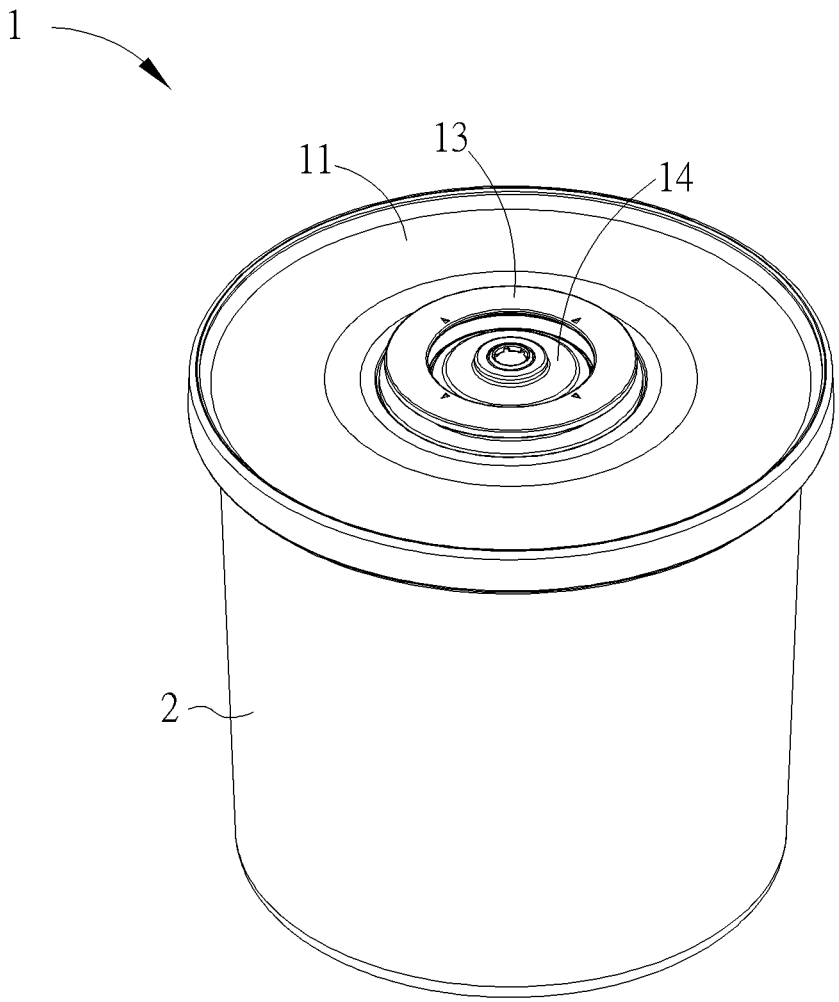
FIG. 1 is a diagram of a cover device attached on a container according to an embodiment of the present invention.
Figure 2:
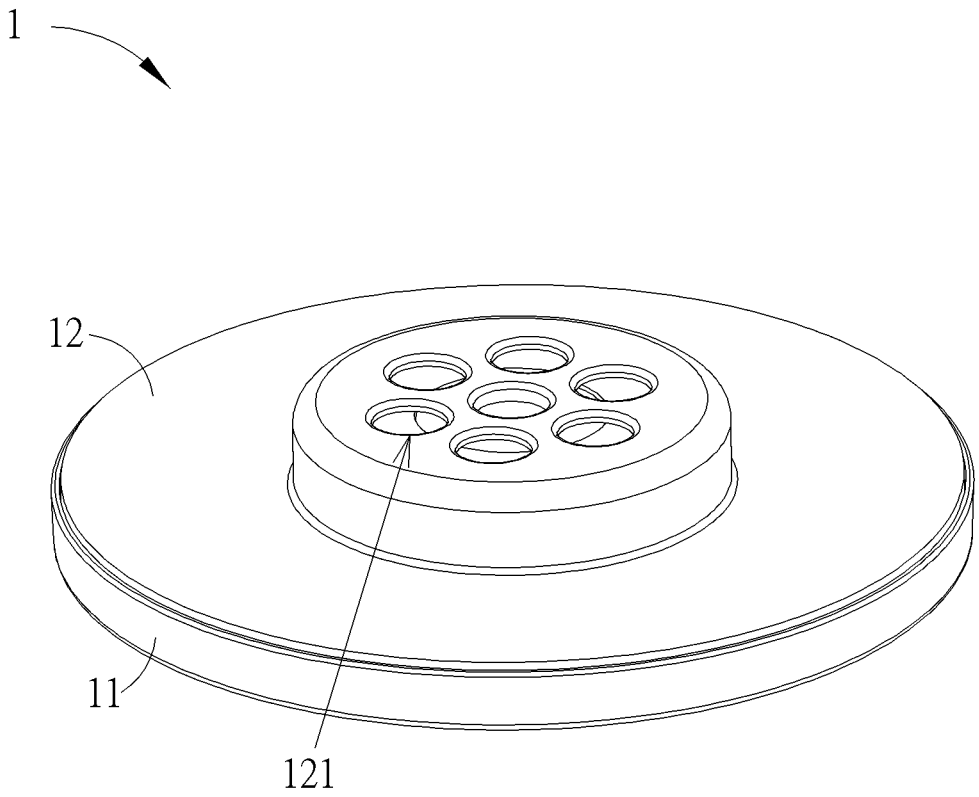
FIG. 2 is a diagram of the cover device at another view according to the embodiment of the present invention.
Figure 3:
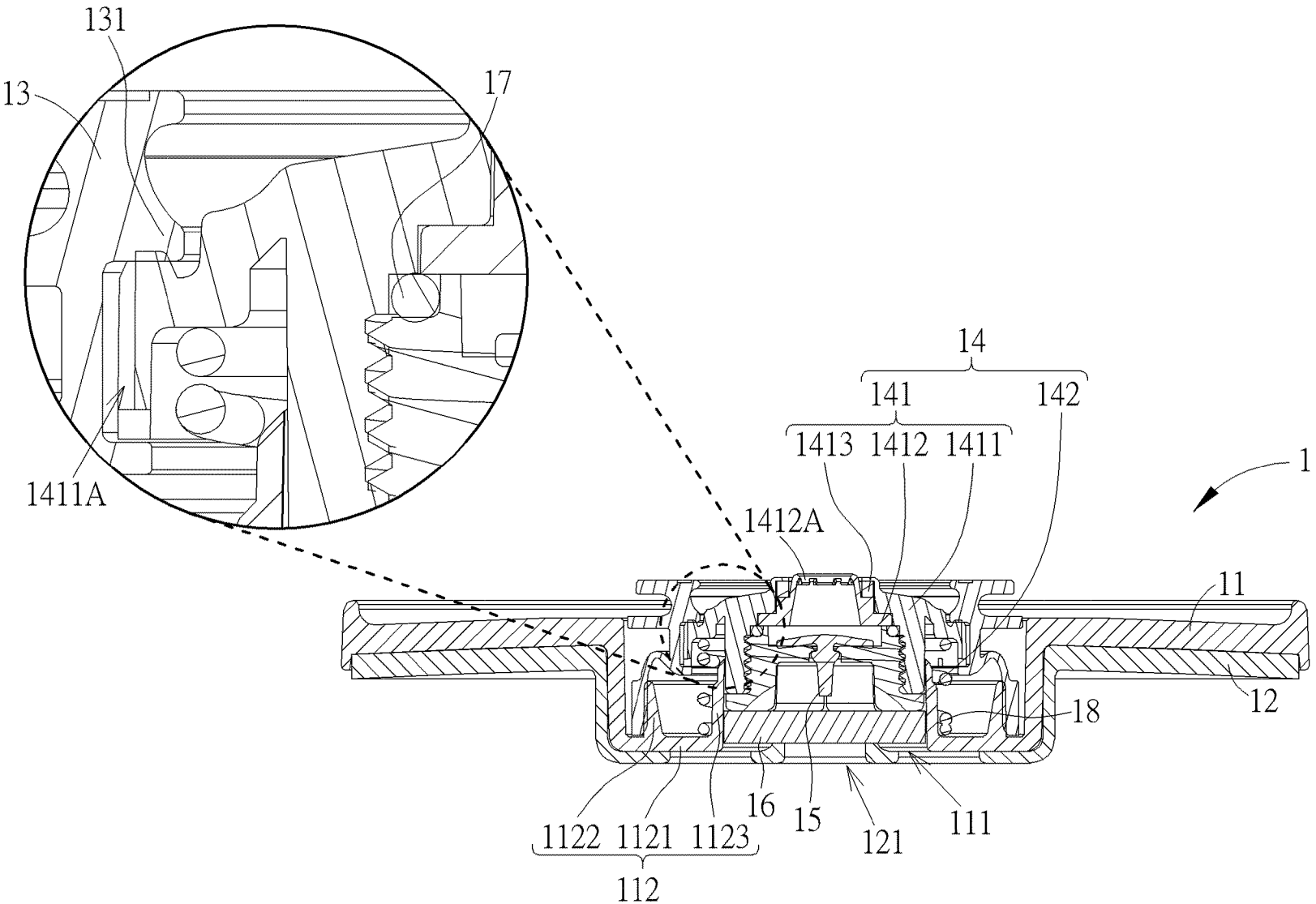
FIG. 3 is a sectional diagram of the cover device according to the embodiment of the present invention.

Please refer to FIG. 1 to FIG. 3. FIG. 1 is a diagram of a cover device 1 attached on a container 2 according to an embodiment of the present invention. FIG. 2 is a diagram of the cover device 1 at another view according to the embodiment of the present invention. FIG. 3 is a sectional diagram of the cover device 1 according to the embodiment of the present invention. As shown in FIG. 1 to FIG. 3, the cover device 1 includes a first body 11, a second body 12, a resilient component 13, a seat assembly 14, a check valve 15 and a filtering component 16. The second body 12 is removably attached on the first body 11 and resiliently deformable. The resilient component 13 is disposed on the first body 11. The seat assembly 14 is movable relative to the first body 11. The seat assembly 14 includes a first seat 141 and a second seat 142. The first seat 141 is removably engaged with the resilient component 13 and configured to be connected to a vacuum device, e.g., a vacuum pump, which is not shown in the figures and is configured to draw air out of an interior of the container 2. The second seat 142 is removably engaged with the first seat 141. The check valve 15 is disposed on the second seat 142. The filtering component 16 is disposed between the second seat 142 and the second body 12.

In this embodiment, the second body 12 and the resilient component 13 can be made of silicone rubber. The check valve 15 can be an umbrella valve. The filtering component 16 can be a foam component. However, the present invention is not limited to this embodiment.

Specifically, as shown in FIGS. 2 and 3, at least one communication hole 121 is formed on the second body 12, and at least one through hole 111 is formed on the first body 11. The check valve 15 is for allowing the air to flow from the interior of the container 2 through the at least one communication hole 121 and the at least one through hole 111 and preventing ambient air from flowing into the interior of the container 2. The filtering component 16 is disposed between the check valve 15 and the at least one through hole 111 for filtering particles in the air flowing from the interior of the container 2 through the at least one communication hole 121 and the at least one through hole 111, so as to prevent damage of the check valve 15 caused by the particles.

Figure 4:
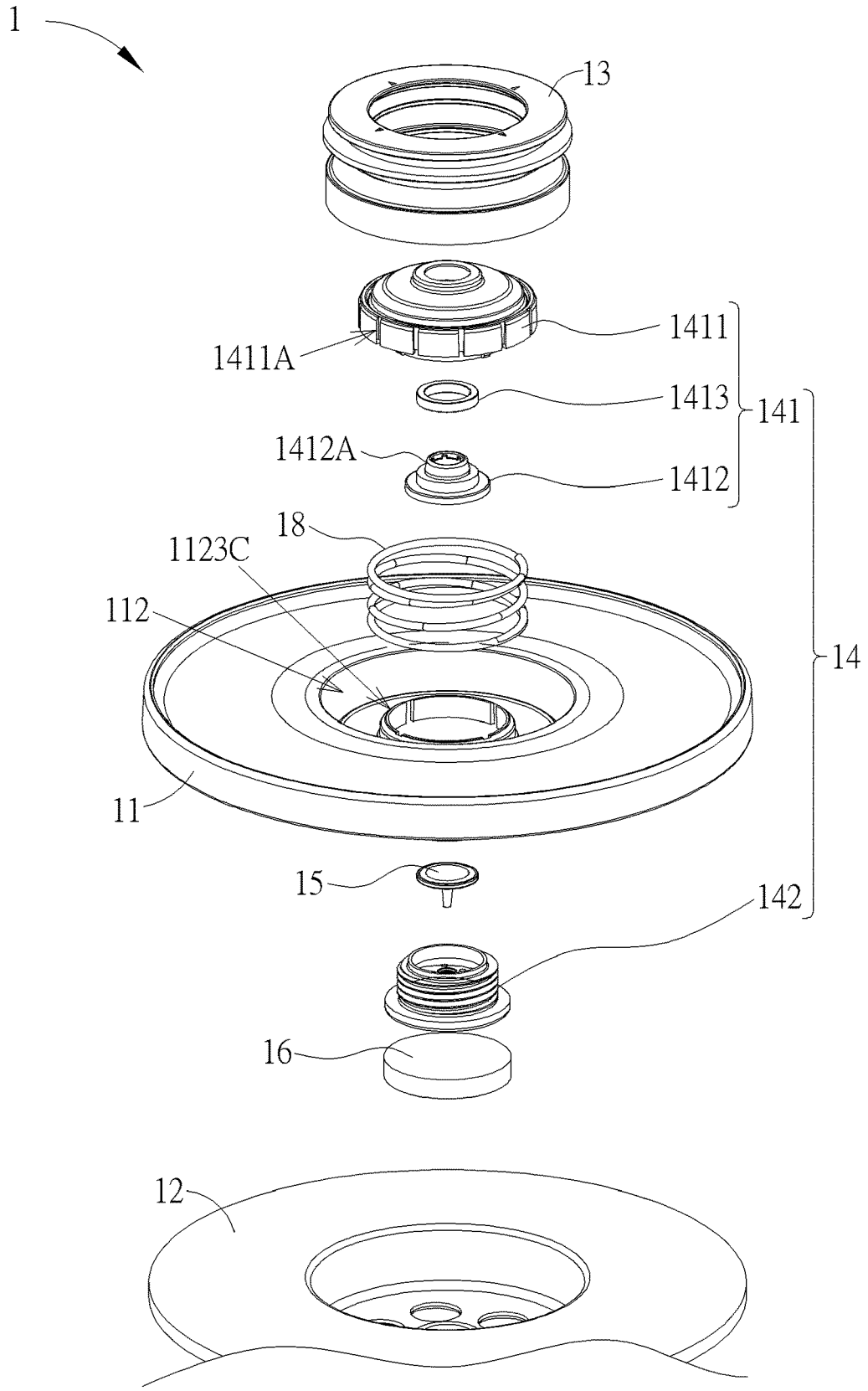
FIG. 4 and FIG. 5 are partial exploded diagrams of the cover device at different views according to the embodiment of the present invention.
Figure 5:
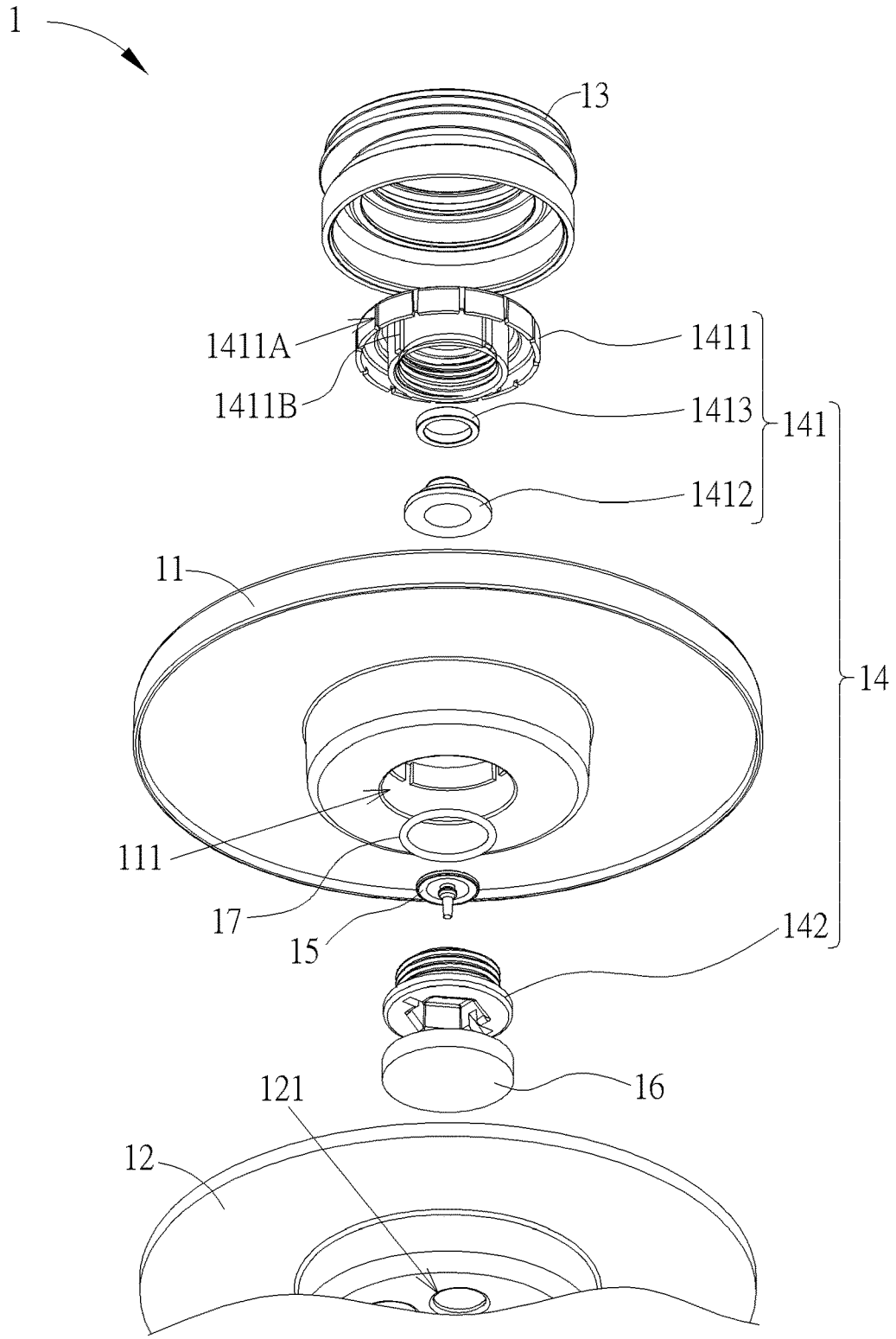
Figure 6:
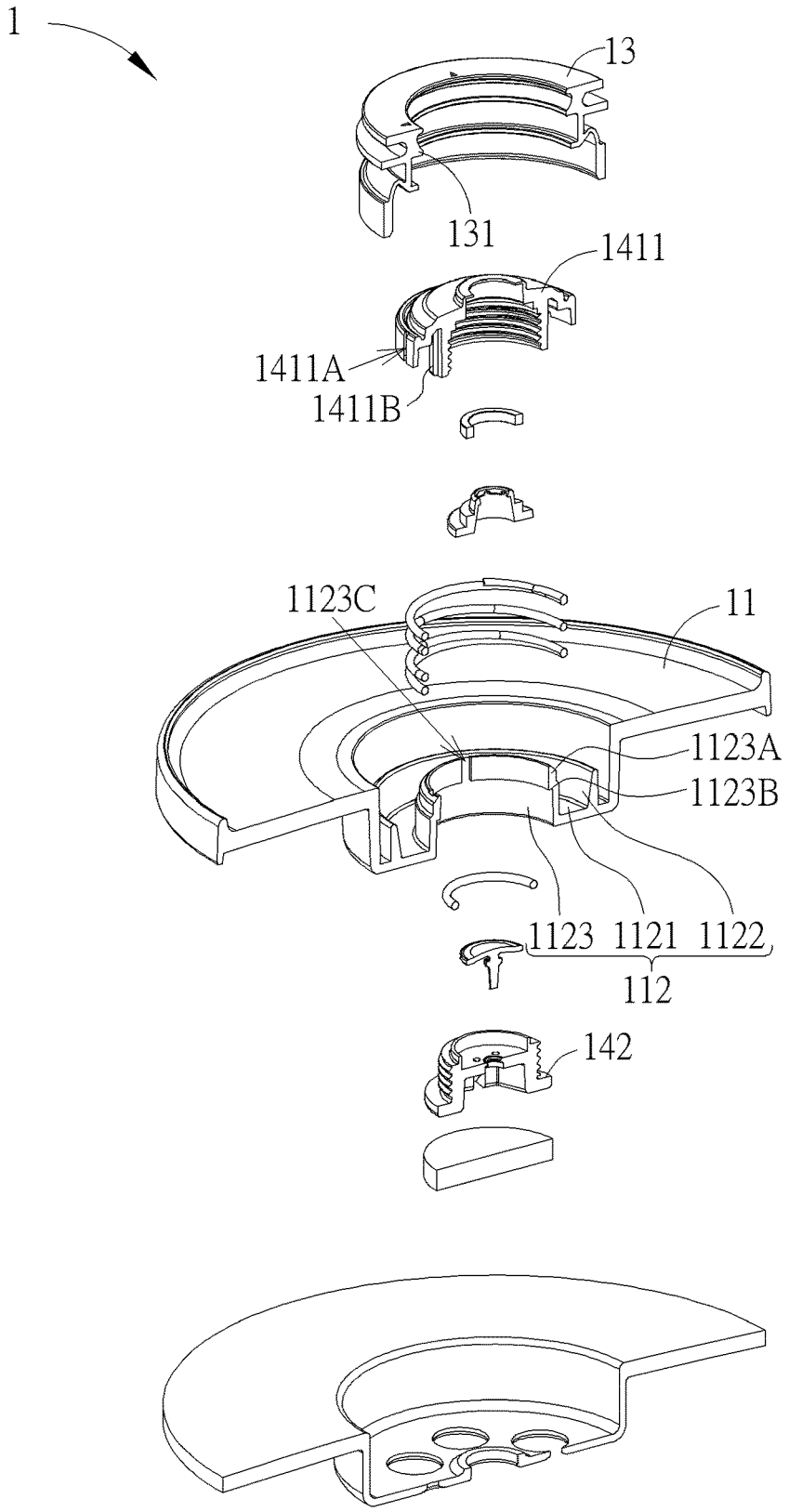
FIG. 6 is a sectional exploded diagram of the cover device according to the embodiment of the present invention.

Please refer to FIG. 3 to FIG. 6. FIG. 4 and FIG. 5 are partial exploded diagrams of the cover device 1 at different views according to the embodiment of the present invention. FIG. 6 is a sectional exploded diagram of the cover device 1 according to the embodiment of the present invention. As shown in FIG. 3 to FIG. 6, the first seat 141 includes an engaging component 1411 and a connecting component 1412. The engaging component 1411 is removably engaged with the resilient component 13. The connecting component 1412 is removably engaged with the engaging component 1411, and the connecting component 1412 includes a connecting structure 1412A protruding out of the engaging component 1411 and configured to be connected to the vacuum device.

As shown in FIG. 3 to FIG. 6, in this embodiment, the first seat 141 further includes a magnetic component 1413 disposed between the engaging component 1411 and the connecting component 1412 to magnetically attract the vacuum device for facilitating a connection of the connecting structure 1412A and the vacuum device.

However, the present invention is not limited to this embodiment. For example, in another embodiment, the magnetic component can be omitted, and the engaging component and the connecting component can be integrally formed with each other. Alternatively, in another embodiment, the engaging component and the connecting component can be integrally formed with each other, and the magnetic component can be embedded inside an integral structure formed by the engaging component and the connecting component.

Besides, as shown in FIG. 3 to FIG. 5, in this embodiment, the second seat 142 can be rotatably engaged with the first seat 141 and rotatably disengaged from the first seat 141 by a cooperation of an outer thread structure on the second seat 142 and an inner thread structure on the engaging component 1411.

However, the present invention is not limited to this embodiment. For example, in another embodiment, the second seat can be removably engaged with the first seat by a cooperation of an engaging hook and an engaging slot formed on one of the second seat and the first seat and the other of the second seat and the first seat respectively, or by a cooperation of two magnetic components embedded inside the second seat and the first seat respectively.

As shown in FIG. 3, in this embodiment, the cover device 1 further includes a sealing component 17 disposed in a space defined by the first seat 141 and the second seat 142. Specifically, the sealing component 17 can be disposed in a space defined by the engaging component 1411, the connecting component 1412 and the second seat 142 for preventing air leakage through a gap between the engaging component 1411 and the connecting component 1412 and/or a gap between the engaging component 1411 and the second seat 142.

However, the present invention is not limited to this embodiment. For example, in another embodiment, the sealing component can be disposed in a space only defined by the engaging component and the second seat. Alternatively, in another embodiment, the sealing component can be omitted.

As shown in FIG. 3, FIG. 4 and FIG. 6, the first body 11 includes a recess structure 112. The recess structure 112 includes a base 1121, a first wall 1122 and a second wall 1123. The at least one through hole 111 is formed on the base 1121. The first wall 1122 is adjacent to an outer periphery of the base 1121 and configured to removably engage with the resilient component 13. The second wall 1123 is adjacent to an inner periphery of the base 1121 and surrounds the at least one through hole 111, and the second wall 1123 is configured to cooperate with the seat assembly 14.

In addition, as shown in FIG. 3, FIG. 4 and FIG. 6, in this embodiment, the cover device 1 further includes a recovering component 18 disposed between the first body 11 and the first seat 141 and for recovering the first seat 141. Specifically, the recovering component 18 can be sleeved on the second wall 1123 and abut against the base 1121 and the engaging component 1411.

However, the present invention is not limited to this embodiment. For example, in another embodiment, the first seat can be driven to recover by a resilient force provided by the resilient component, and the recovering component can be omitted.

As shown in FIG. 6, in this embodiment, the seat assembly 14 is only allowed to move within a limited range during a normal operation. Specifically, the second wall 1123 includes a first stopping portion 1123A and a second stopping portion 1123B for respectively abutting against the engaging component 1411 and the second seat 142 to restrain a traveling distance of the seat assembly 14.

However, the present invention is not limited to this embodiment. For example, in another embodiment, the first stopping portion and the second stopping portion can be omitted.

Furthermore, as shown in FIG. 4 to FIG. 6, in order to facilitate an engagement of the first seat 141 and the second seat 142 and ensure a stable movement of the seat assembly 14, at least one first guiding structure 1411B is arranged on the engaging component 1411, and at least one second guiding structure 1123C is arranged on the second wall 1123 and configured to cooperate with the at least one first guiding structure 1411B for preventing a rotating movement of the engaging component 1411 when the seat assembly 14 moves relative to the first body 11 and when the second seat 142 is engaged with the engaging component 1411.

As shown in FIG. 3 to FIG. 6, in order to achieve easy pressure relief, at least one channel 1411A is formed on an outer periphery of the engaging component 1411. The resilient component 13 includes at least one inner rib 131 configured to engage with the outer periphery of the engaging component 1411 for blocking the at least one channel 1411A, and the resilient component 13 is resiliently deformed to disengage the at least one inner rib 131 from the outer periphery of the engaging component 1411 so that the at least one inner rib 131 does not block the at least one channel 1411A to allow pressure relief.

Figure 7:
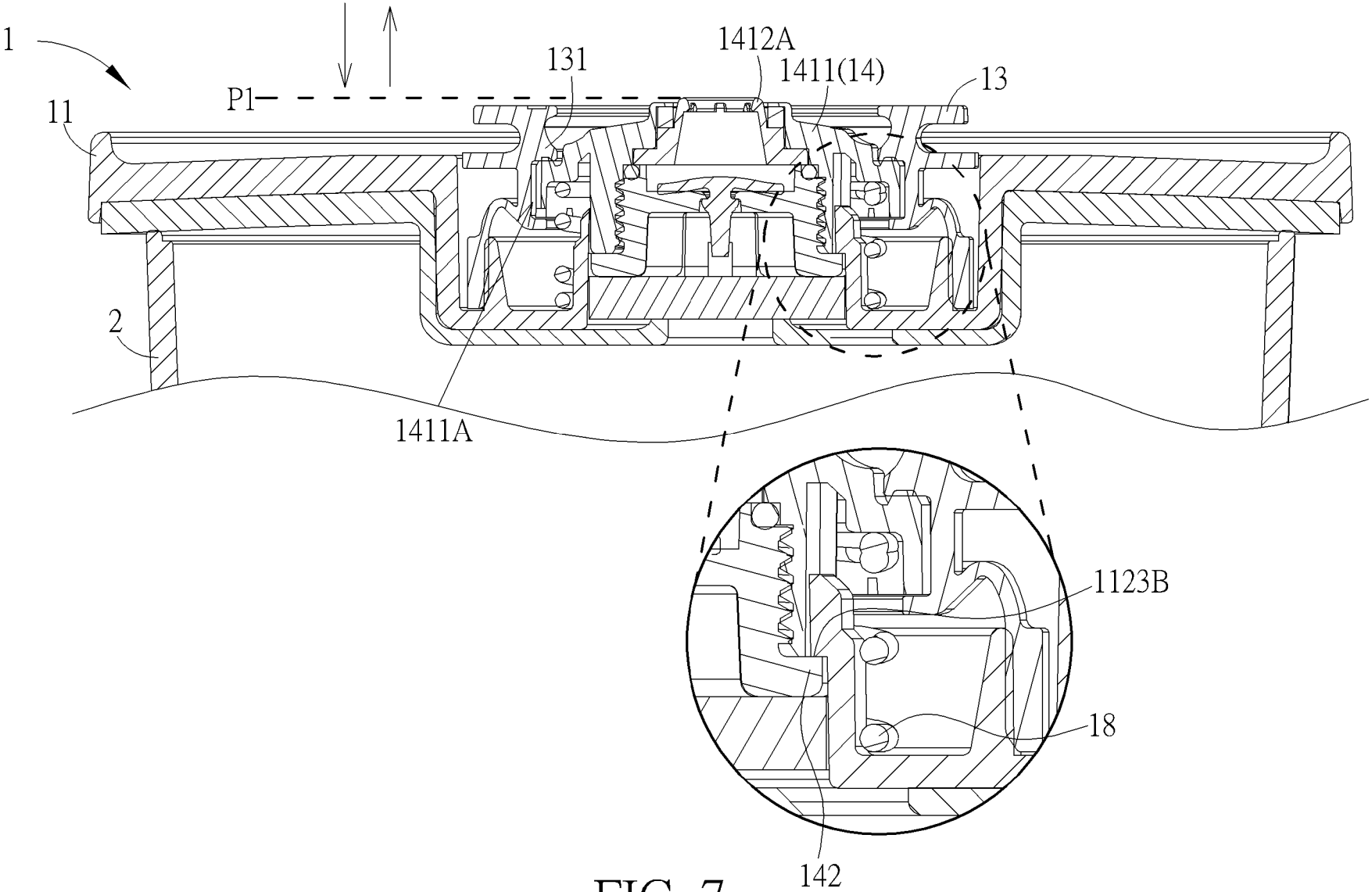
FIG. 7 is a diagram of the cover device in a first used state according to the embodiment of the present invention.
Figure 8:
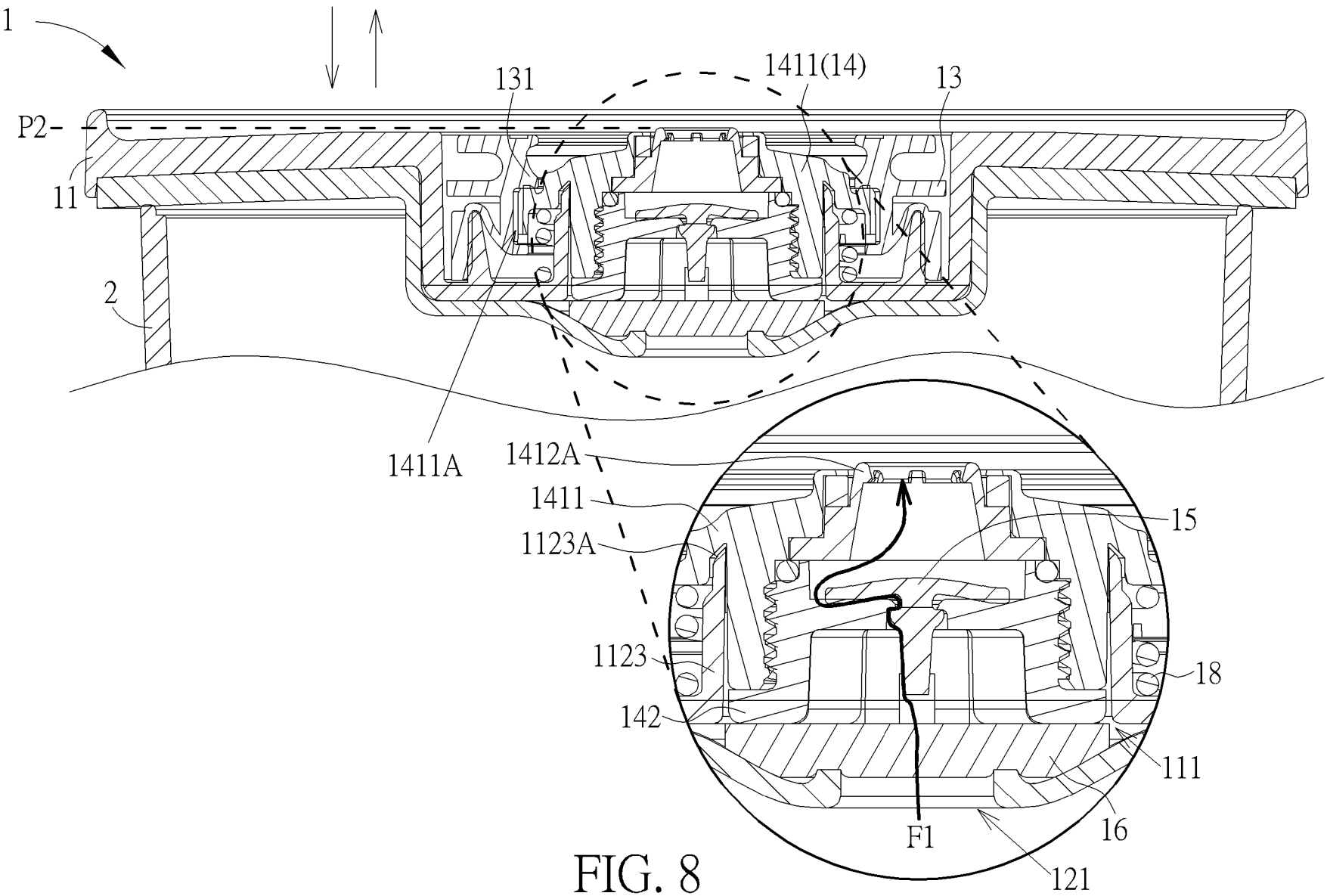
FIG. 8 is a diagram of the cover device in a second used state according to the embodiment of the present invention.
Figure 9:
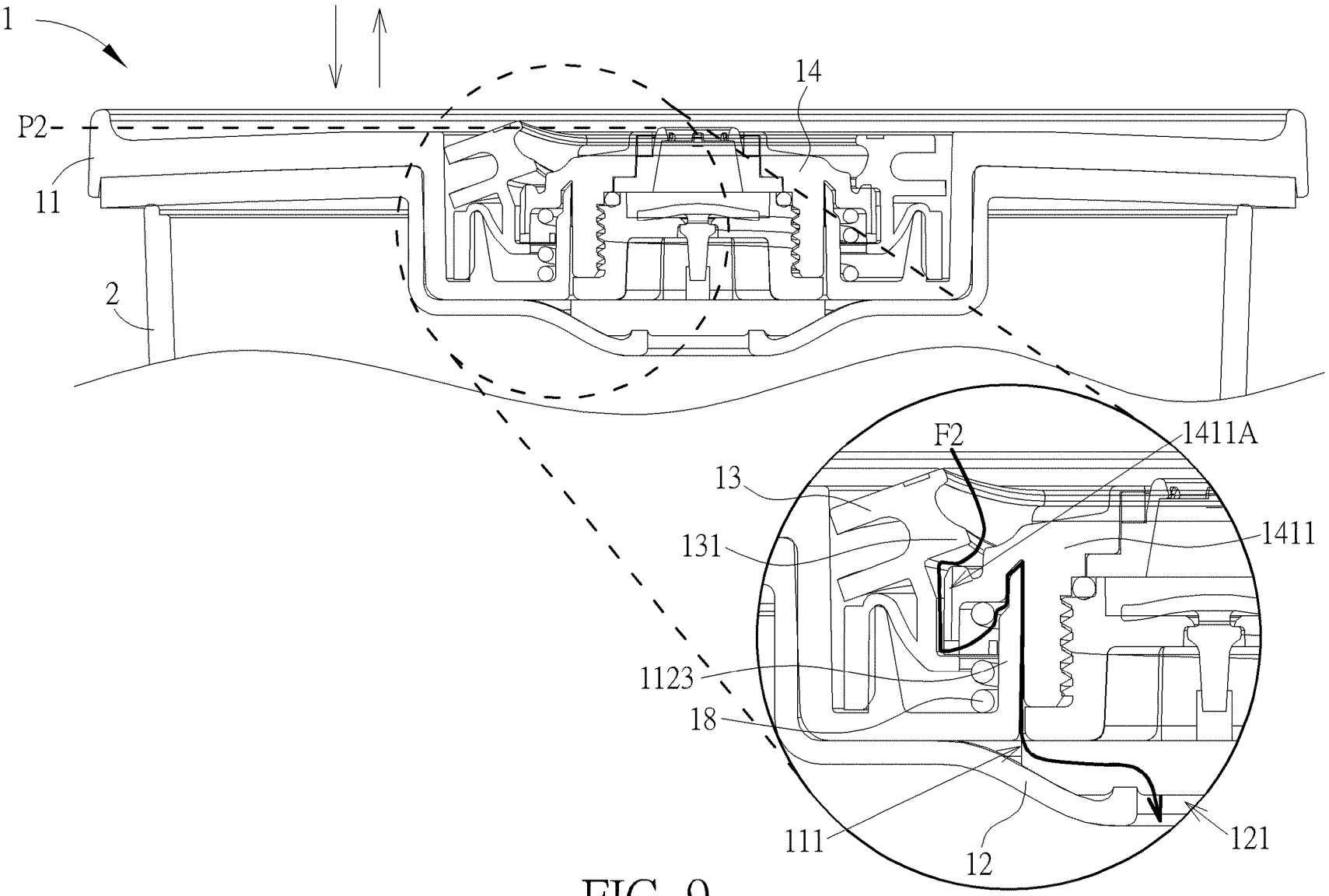
FIG. 9 is a diagram of the cover device in a third used state according to the embodiment of the present invention.

Detailed description for the operational principle of the cover device 1 is provided as follows. FIG. 7 is a diagram of the cover device 1 in a first used state according to the embodiment of the present invention. FIG. 8 is a diagram of the cover device 1 in a second used state according to the embodiment of the present invention. FIG. 9 is a diagram of the cover device 1 in a third used state according to the embodiment of the present invention. Before the vacuum device is connected to the connecting structure 1412A, or when the vacuum device is not activated for drawing the air out of the interior of the container 2, a pressure of the interior of the container 2 is substantially equal to an ambient pressure. Therefore, at this moment, the cover device 1 is in the first used state, i.e., the seat assembly 14 is driven to the first position P1 by the recovering component 18 and/or the resilient component 13, and the second stopping portion 1123B abuts against the second seat 142 for positioning the seat assembly 14 at the first position P1. After the vacuum device is connected to the connecting structure 1412A and activated for drawing the air out of the interior of the container 2 through a first path F1 as shown in FIG. 8, i.e., through the at least one communication hole 121, the at least one through hole 111, at least one gap between the check valve 15 and the second seat 142, and the connecting structure 1412A, the pressure of the interior of the container 2 gradually decreases, such that a difference between the pressure of the interior of the container 2 and the ambient pressure causes the seat assembly 14 to move from the first position P1 as shown in FIG. 7 to a second position P2 as shown in FIG. 8 and to resiliently deform the recovering component 18 and the resilient component 13. When the seat assembly 14 is located the second position P2 as shown in FIG. 8, the first stopping portion 1123A abuts against the engaging component 1411 for positioning the seat assembly 14 at the second position P2, and the filtering component 16 is resiliently deformed and is driven by the second seat 142 to at least partially protrude out of a space defined by the second wall 1123 through the through hole 111, so as to resiliently deform the second body 12. Therefore, the pressure of the interior of the container 2 can be estimated by observing a position of the seat assembly 14 easily. During the aforementioned process, the at least one inner rib 131 keeps engaging with the outer periphery of the engaging component 1411 to block the at least one channel 1411, which facilitates drawing the air out of the interior of the container 2.

As shown in FIG. 9, when it is desired to detach the cover device 1 from the container 2, the resilient component 13 can be resiliently deformed, e.g., by an external force, to disengage the at least one inner rib 131 from the outer periphery of the engaging component 1411 so that the at least one inner rib 131 does not block the at least one channel 1411A, so as to allow the ambient air to flow into the interior of the container 2 through a second path F2, i.e., through the at least one channel 1411A, at least one gap between the seat assembly 14 and the second wall 1123, the at least one through hole 111, and the at least one communication hole 121, for pressure relief. During the aforementioned pressure relief process, the pressure of the interior of the container 2 gradually increases until the pressure of the interior of the container 2 is equal to the ambient pressure, i.e., the difference between the pressure of the interior of the container 2 and the ambient pressure is reduced to zero substantially, such that the seat assembly 14 is driven to move from the second position P2 as shown in FIG. 8 back to the first position P1 as shown in FIG. 7 by the recovering component 18 and/or the resilient component 13 and positioned at the first position P1 by an abutment of the second stopping portion 1123B and the second seat 142. After the seat assembly 14 moves to the first position P1 as shown in FIG. 7, the cover device 1 can be detached from the container 2 easily.

In contrast to the prior art, the present invention enables the seat assembly to move from a higher position, e.g., the first position, to a lower position, e.g., the second position, when the pressure of the interior of the container gradually decreases. Besides, the present invention further enables the seat assembly to move from the lower position, e.g., the second position, to the higher position, e.g., the first position, when the pressure of the interior of the container gradually increases. Therefore, the pressure of the interior of the container can be estimated by observing the position of the seat assembly easily. Besides, an air passage can be formed for allowing ambient air to flow into the interior of the container when the resilient component is resiliently deformed to drive at least a portion of the resilient component, e.g., the inner rib of the resilient component, and at least a portion of the seat assembly, e.g., the outer periphery of the engaging component of the first seat of the seat assembly, to disengage from each other. Therefore, the present invention has simple and intuitive use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A cover device comprising:
- a first body;
- a second body removably attached on the first body and resiliently deformable;
- a resilient component disposed on the first body;
- a seat assembly movable relative to the first body, the seat assembly comprising:
  - a first seat removably engaged with the resilient component and configured to be connected to a vacuum device; and
  - a second seat removably engaged with the first seat;
- a check valve disposed on the second seat; and
- a filtering component disposed between the second seat and the second body.

2. The cover device of claim 1, wherein the first seat comprises an engaging component and a connecting component, the engaging component is removably engaged with the resilient component, the connecting component is removably engaged with the engaging component, and the connecting component comprises a connecting structure protruding out of the engaging component and configured to be connected to the vacuum device.

3. The cover device of claim 2, further comprising a recovering component disposed between the first body and the engaging component and for recovering the engaging component.

4. The cover device of claim 2, wherein the first seat further comprises a magnetic component disposed between the engaging component and the connecting component.

5. The cover device of claim 2, wherein at least one channel is formed on an outer periphery of the engaging component, the resilient component comprises at least one inner rib configured to engage with the outer periphery of the engaging component for blocking the at least one channel, and the resilient component is resiliently deformed to disengage the at least one inner rib from the outer periphery of the engaging component so that the at least one inner rib does not block the at least one channel.

6. The cover device of claim 2, wherein the first body comprises a recess structure, the recess structure comprises a base, a first wall and a second wall, a through hole is formed on the base, the first wall is adjacent to an outer periphery of the base and configured to removably engage with the resilient component, the second wall is adjacent to an inner periphery of the base and surrounds the through hole, and the second wall is configured to cooperate with the seat assembly.

7. The cover device of claim 6, further comprising a recovering component sleeved on the second wall and abutting against the base and the engaging component, and the recovering component being configured to recover the engaging component.

8. The cover device of claim 6, wherein the seat assembly is movable between a first position and a second position, the second wall comprises a first stopping portion and a second stopping portion, the first stopping portion abuts against the engaging component when the seat assembly is located at the second position, and the second stopping portion abuts against the second seat when the seat assembly is located at the first position.

9. The cover device of claim 6, wherein at least one first guiding structure is arranged on the engaging component, and at least one second guiding structure is arranged on the second wall and configured to cooperate with the at least one first guiding structure for preventing a rotating movement of the engaging component.

10. The cover device of claim 6, wherein the filtering component is driven by the second seat to at least partially protrude out of a space defined by the second wall through the through hole, so as to resiliently deform the second body.

11. The cover device of claim 2, further comprising a sealing component disposed in a space defined by the engaging component, the connecting component and the second seat.

12. The cover device of claim 1, further comprising a recovering component disposed between the first body and the first seat and for recovering the first seat.

13. The cover device of claim 1, wherein at least one channel is formed on an outer periphery of the first seat, the resilient component comprises at least one inner rib configured to engage with the outer periphery of the first seat for blocking the at least one channel, and the resilient component is resiliently deformed to disengage the at least one inner rib from the outer periphery of the first seat so that the at least one inner rib does not block the at least one channel.

14. The cover device of claim 1, wherein the first body comprises a recess structure, the recess structure comprises a base, a first wall and a second wall, a through hole is formed on the base, the first wall is adjacent to an outer periphery of the base and configured to removably engage with the resilient component, the second wall is adjacent to an inner periphery of the base and surrounds the through hole, and the second wall is configured to cooperate with the seat assembly.

15. The cover device of claim 14, further comprising a recovering component sleeved on the second wall and abutting against the base and the first seat, and the recovering component being configured to recover the first seat.

16. The cover device of claim 14, wherein the seat assembly is movable between a first position and a second position, the second wall comprises a first stopping portion and a second stopping portion, the first stopping portion abuts against the first seat when the seat assembly is located at the second position, and the second stopping portion abuts against the second seat when the seat assembly is located at the first position.

17. The cover device of claim 14, wherein at least one first guiding structure is arranged on the first seat, and at least one second guiding structure is arranged on the second wall and configured to cooperate with the at least one first guiding structure for preventing a rotating movement of the first seat.

18. The cover device of claim 1, wherein the filtering component is driven by the second seat to at least partially protrude out of the first body, so as to resiliently deform the second body.

19. The cover device of claim 1, wherein the seat assembly is movable between a first position and a second position, the first body comprises a first stopping portion and a second stopping portion, the first stopping portion abuts against the first seat when the seat assembly is located at the second position, the second stopping portion abuts against the second seat when the seat assembly is located at the first position, at least one first guiding structure is arranged on the first seat, and at least one second guiding structure is arranged on the first body and configured to cooperate with the at least one first guiding structure for preventing a rotating movement of the first seat.

20. The cover device of claim 1, further comprising a sealing component disposed in a space defined by the first seat and the second seat.

* * * * *